United States Patent [19]

Watanabe

[11] Patent Number: 5,005,540

[45] Date of Patent: Apr. 9, 1991

[54] VALVE TIMING CONTROL SYSTEM FOR AN INTERNAL COMBUSTION ENGINE

[75] Inventor: Kenzo Watanabe, Fuchu, Japan

[73] Assignee: Fuji Jukogyo Kabushiki Kaisha, Tokyo, Japan

[21] Appl. No.: 541,711

[22] Filed: Jun. 21, 1990

[51] Int. Cl.[5] ..... F01L 9/02

[52] U.S. Cl. ..... 123/90.12; 123/90.15

[58] Field of Search ..... 123/90.12, 90.16, 90.13, 123/90.15, 90.48, 90.49, 90.55, 90.52

[56] References Cited

U.S. PATENT DOCUMENTS

| | | | |
|---|---|---|---|
| 4,671,221 | 6/1987 | Geringer et al. | 123/90.12 |
| 4,688,525 | 8/1987 | Nakamura | 123/90.55 |
| 4,696,265 | 9/1987 | Nohira | 123/90.12 |
| 4,867,113 | 9/1989 | Pieprzak et al. | 123/90.55 |
| 4,873,949 | 10/1989 | Fujiyoshi et al. | 123/90.12 |
| 4,889,084 | 12/1989 | Rembold | 123/90.12 |
| 4,889,085 | 12/1989 | Yagi et al. | 123/90.55 |
| 4,892,067 | 1/1990 | Paul et al. | 123/90.12 |

FOREIGN PATENT DOCUMENTS 61-93216 5/1986 Japan .

*Primary Examiner*—David A. Okonsky
*Assistant Examiner*—Weilun Lo
*Attorney, Agent, or Firm*—Martin A. Farber

[57] ABSTRACT

A hydraulic valve lifter is disposed between a cam and a valve. The hydraulic valve lifter comprises a cylindrical lifter body, a cam piston slidably mounted in the lifter body, and a lifter piston slidably mounted in the lifter body. The cam piston engages with the cam and the lifter piston engages with the valve. A hydraulic circuit is provided for supplying oil to an oil chamber in the valve lifter. An electromagnetic relief valve is provided in a relief passage for draining the oil chamber. The relief valve is closed in accordance with engine operating conditions, thereby controlling the valve timing.

4 Claims, 4 Drawing Sheets

VALVE TIMING CONTROL SYSTEM FOR AN INTERNAL COMBUSTION ENGINE

BACKGROUND OF THE INVENTION

The present invention relates to a system for controlling valve timing for intake and exhaust valves of an automotive engine, and more particularly to a valve timing control system having a hydraulic valve lifter.

It has been proposed to provide a valve timing control system for the automotive engine, which operates to reduce duration of valve opening at low speed in a light load range in order to reduce fuel consumption and to stabilize engine operation. At high speed in a heavy load range, the duration of the valve opening is increased in order to produce a large engine power. There have been proposed various methods for controlling the valve timing. If a lift displacement of the valve is changed, the duration is changed. For example, when the lift displacement is increased, the duration is increased. Accordingly, a method is proposed to provide a hydraulic valve lifter between a cam and a valve stem and to provide a control system for controlling pressure of oil in the valve lifter.

Japanese Patent Application Laid-Open 61-93216 discloses a valve timing control system in which a hydraulic valve lifter has a cup-shaped outer lifter, a hollow inner lifter engaged with the outer lifter, and a high pressure oil chamber provided between the outer and inner lifters. A check valve is provided in a passage communicated with the oil chamber. The check valve is operated by an electromagnetic valve to be opened for controlling the pressure of oil in the oil chamber.

In the system, pressure receiving area of the outer lifter engaging the valve is equal to pressure receiving area of the inner lifter engaging the cam. Consequently, an amount of the valve lift is equal to or smaller than that of the cam lift. Therefore, it is difficult to increase the duration of valve opening and to reduce a size of a cam mechanism.

SUMMARY OF THE INVENTION

An object of the present invention is to provide a valve timing control system in which valve timing is properly controlled in a wide engine operating range.

Another object of the present invention is to provide the valve timing control system which may increase the duration of valve opening.

According to the present invention, there is provided a valve timing control system for an internal combustion engine having cylinders, valves for inducing air and exhausting burned gases, a cam for operating each valve, and a hydraulic valve lifter disposed between the cam and the valve.

The system comprises the hydraulic valve lifter with a cylindrical lifter body secured to the engine, a cam piston having a large area for receiving hydraulic pressure and slidably mounted in the lifter body, and a lifter piston having a small area for receiving the hydraulic pressure and slidably mounted in the lifter body to define an oil chamber together with the cam piston, an outer surface of the cam piston being engaged with the cam and an outer surface of the lifter piston being engaged with the valve, a hydraulic circuit having an oil supply passage for supplying oil to the oil chamber and a relief passage, an electromagnetic relief valve provided in the relief passage for draining the oil chamber, and a control unit for operating the relief valve in accordance with engine operating conditions.

In an aspect of the invention, the lifter body has a large diameter cylindrical portion in which the cam piston is slidably mounted, and a small diameter cylindrical portion in which the lifter piston in slidably mounted. The control unit produces a relief valve timing signal for closing the electromagnetic relief valve at a time in accordance with engine speed. The relief valve timing signal is produced at a retarded time when the engine speed is low.

The other objects and features of this invention will become understood from the following description with reference to the accompanying drawings.

DETAILED DESCRIPTION OF THE PREFERRED EMBODIMENT

Figure 1:
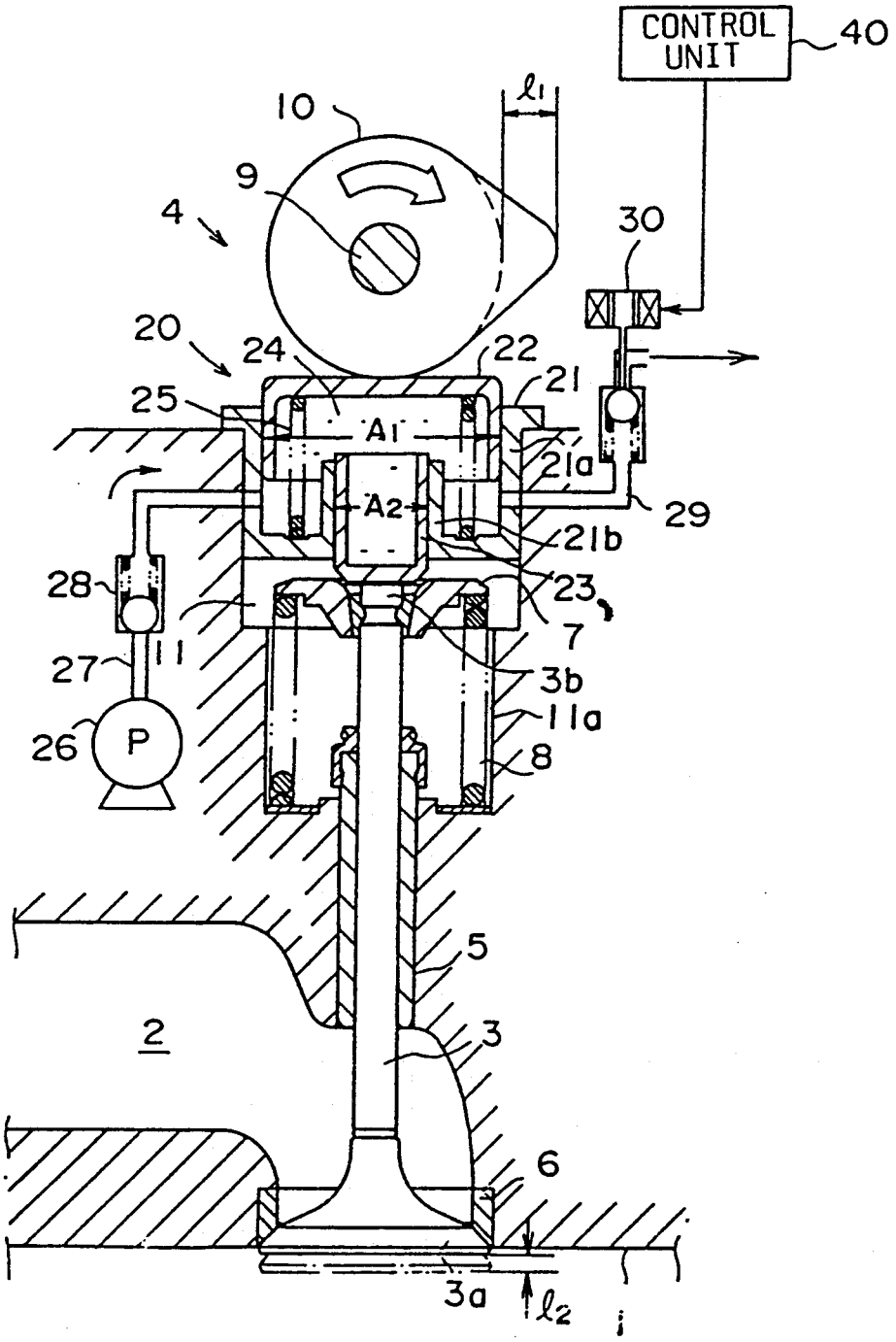
FIG. 1 is a sectional view showing a valve timing control system according to the present invention.

Referring to FIG. 1 showing a valve timing control system according to the present invention, a cylinder head 1 of an internal combustion engine has an intake (exhaust) port 2, an intake (exhaust) valve 3 provided for closing the intake port 2, and a valve mechanism 4. The valve 3 (for example intake valve 3) is slidably mounted in a valve guide 5 secured in the cylinder head 1. A contact surface **3*a* of the valve 3 is engaged with a valve seat 6 embeded in the cylinder head 1. A spring retainer 7 is secured to a stem end 3*b* of the valve 3. A valve spring 8 is provided between the retainer 7 and a bottom of a recess 11*a* to urge the valve 3 to a closing position. The valve mechanism 4 is disposed above the stem end 3*b* of the valve. The valve mechanism 4 comprises a cam 10 formed on a camshaft 9 and a hydraulic valve lifter 20. The cam 10 is disposed in a plane passing an axis of the valve 3 so as to operate the valve 3 through the valve lifter 20**.

The hydraulic valve lifter 20 is provided in the cylinder head 1 between the valve 3 and the cam 10. The valve lifter 20 comprises a cylindrical lifter body 21 securely inserted in a recess 11 by press fit at a predetermined distance from the retainer 7. The recess 11 has a lower recess **11*a* at the bottom. The lifter body 21 has a large diameter cylindrical portion 21*a* and a small diameter cylindrical portion 21*b* formed on the bottom of the lifter body 21 at a central portion thereof. A cam piston 22 having a large pressure receiving area A1 is slidably mounted in the large diameter cylindrical portion 21*a*. The bottom of the cam piston 22 corresponds to the cam 10. A lifter piston 23 having a small pressure receiving area A2 is slidably mounted in the small diameter cylindrical portion 21*b*. The bottom of the lifter piston 23 corresponds to the valve 3. An oil chamber 24 is formed in the lifter body 21 between the cam piston 22 and the lifter piston 23. A spring 25 is provided between the bottom of the piston 22 and the bottom of the lifter body 21 to urge the piston 22 to the cam 10. The lifter piston 23 is abutted on the stem end 3*b* of the valve 3. The valve 3 is lifted in accordance with a ratio (A1-/A2) between the large pressure receiving area A1 of the cam piston 22 and the small pressure receiving area A2 of the lifter piston 23 and a cam lift l1. Namely, a valve lift λ2 of the valve 3** is represented as $$l2 = A1/A2 \times l1$$

In other words the cam lift l1 is multiplied by the ratio (A1/A2) of the pressure receiving areas to provide the large valve lift l2.

Oil from an oil pump 26 is supplied to the oil chamber 24 through an oil supply passage 27 in which a check valve 28 is provided. The oil chamber 24 communicates with a relief passage 29 in which an electromagnetic relief valve 30 is provided for draining the oil chamber. The relief valve 30 is operated in accordance with a signal from a control unit 40 for controlling the amount of drain oil to control effective volume of the oil chamber 24.

Figure 2:
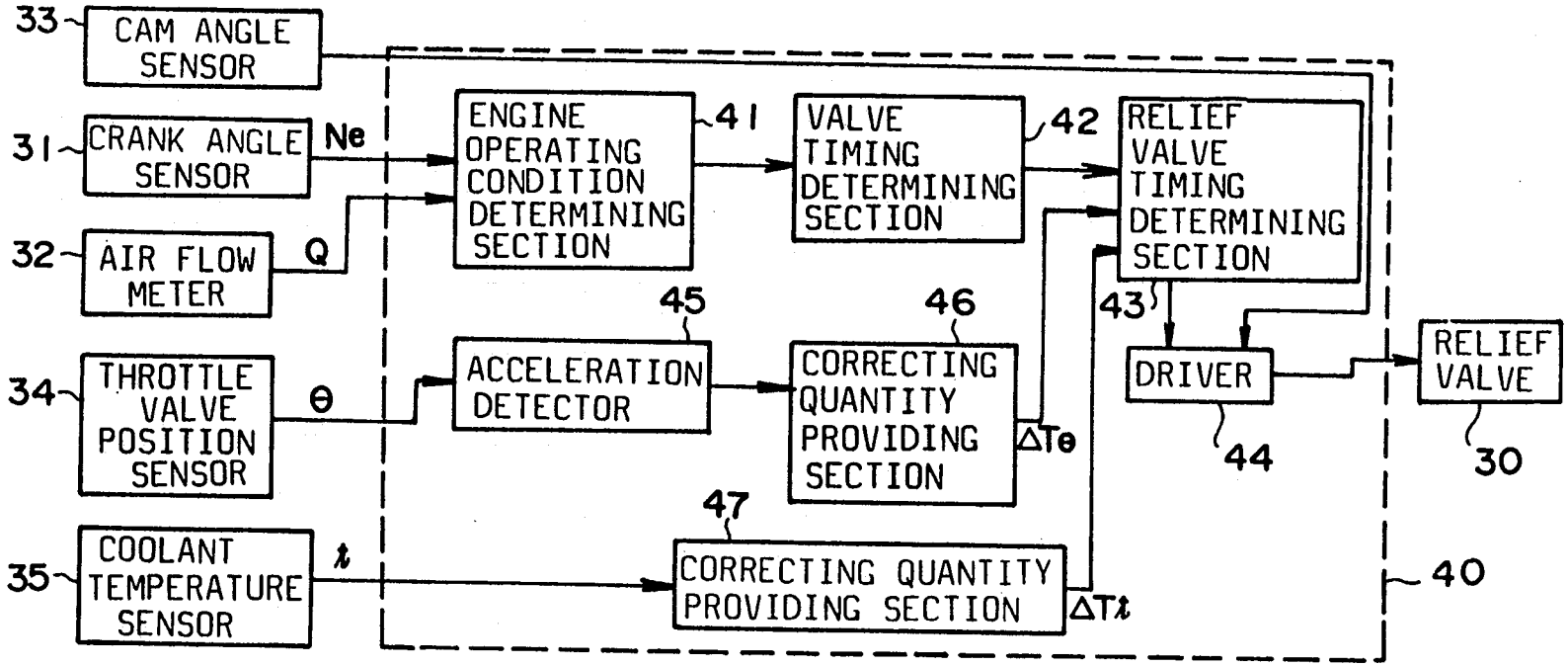
FIG. 2 is a block diagram showing a control unit of the system.
Figure 3:
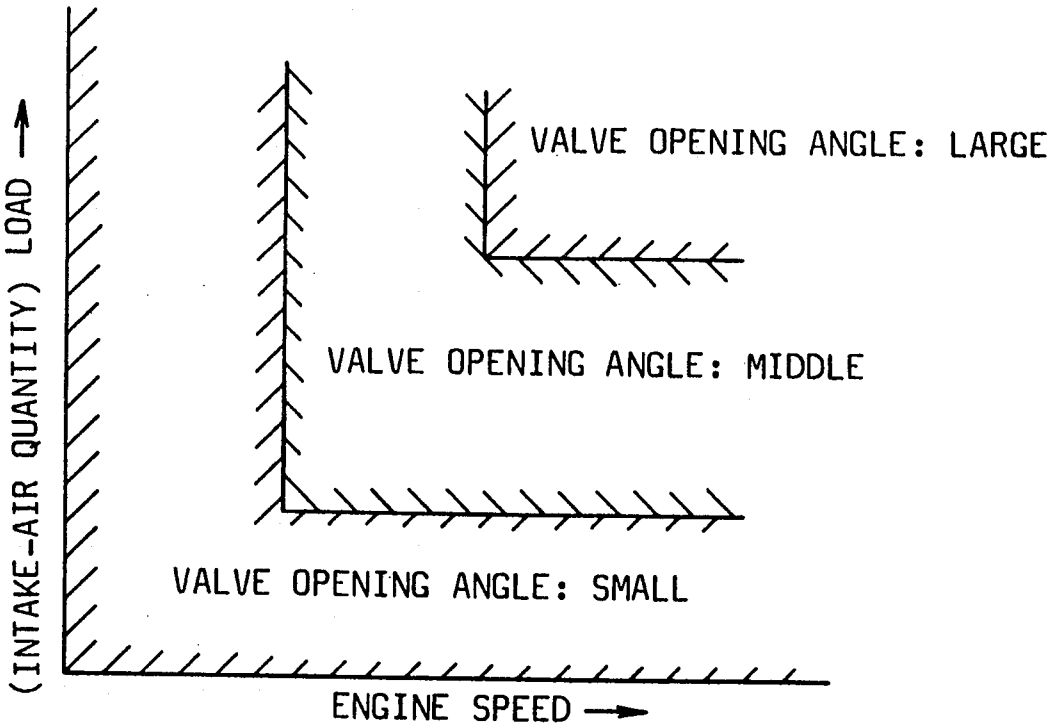
FIG. 3 is a diagram showing characteristics of a valve timing.

Referring to FIG. 2 showing the control unit 40, the system has a crank angle sensor 31 for detecting an engine speed Ne, an air flow meter 32 for detecting quantity of intake air Q corresponding to the engine load, a cam angle sensor 33 for discriminating a number of a corresponding cylinder, a throttle valve position sensor 34 and a coolant temperature sensor 35. The engine speed Ne from the crank angle sensor 31 and the intake air quantity Q from the air flow meter 32 are applied to an engine operating condition determining section 41 in which the engine operating condition is determined in accordance with the engine speed Ne and the intake air quantity Q. An engine operating condition signal is applied to a valve timing determining section 42 in which a valve timing look-up table as shown in FIG. 3 is provided. At low engine speed in a light load range, the valve opening time is retarded so that the duration of valve opening is reduced. At middle speed in a middle load range, the duration of valve opening is increased. At high speed in a heavy load range, the valve opening time is not retarded, thereby providing a long duration of valve opening. An opening angle $\phi$ of the valve 3 corresponding to duration of the valve opening is applied to a relief valve timing providing section 43. A relief valve timing signal from the section 43 is applied to a driver 44 which produces a signal for controlling the relief valve 30.

A throttle valve opening degree $\theta$ from the throttle position sensor 34 is applied to an acceleration detector 45 where a state of acceleration is detected in accordance with $d\theta/dt$. An acceleration signal is applied to a correcting quantity providing section 46 in which a correcting quantity for a valve timing $\Delta T_\theta$ is determined. Coolant temperature t from the coolant temperature sensor 35 is fed to a correcting quantity providing section 47. When the engine is cold, viscosity of oil in the valve lifter becomes high, which causes a deviation of the valve timing from a set timing. To correct the deviation, a correcting quantity $\Delta T_t$ for the valve timing is determined in the section 47. These correcting quantities $\Delta T_\theta$ and $\Delta T_t$ are applied to the relief valve timing providing section 43 where the valve timing is corrected.

In the multiple-cylinder engine, it is difficult to control all hydrualic systems of the hydraulic valve lifters 20 by means of a single relief valve 30. Therefore, the relief valve 30 is provided at every cylinder and independently controlled. Accordingly, a cam angle signal for discriminating the cylinder is applied from the cam angle sensor 33 to the driver 44 in which a timing signal is produced for a corresponding cylinder in response to igniting order.

Figure 4:
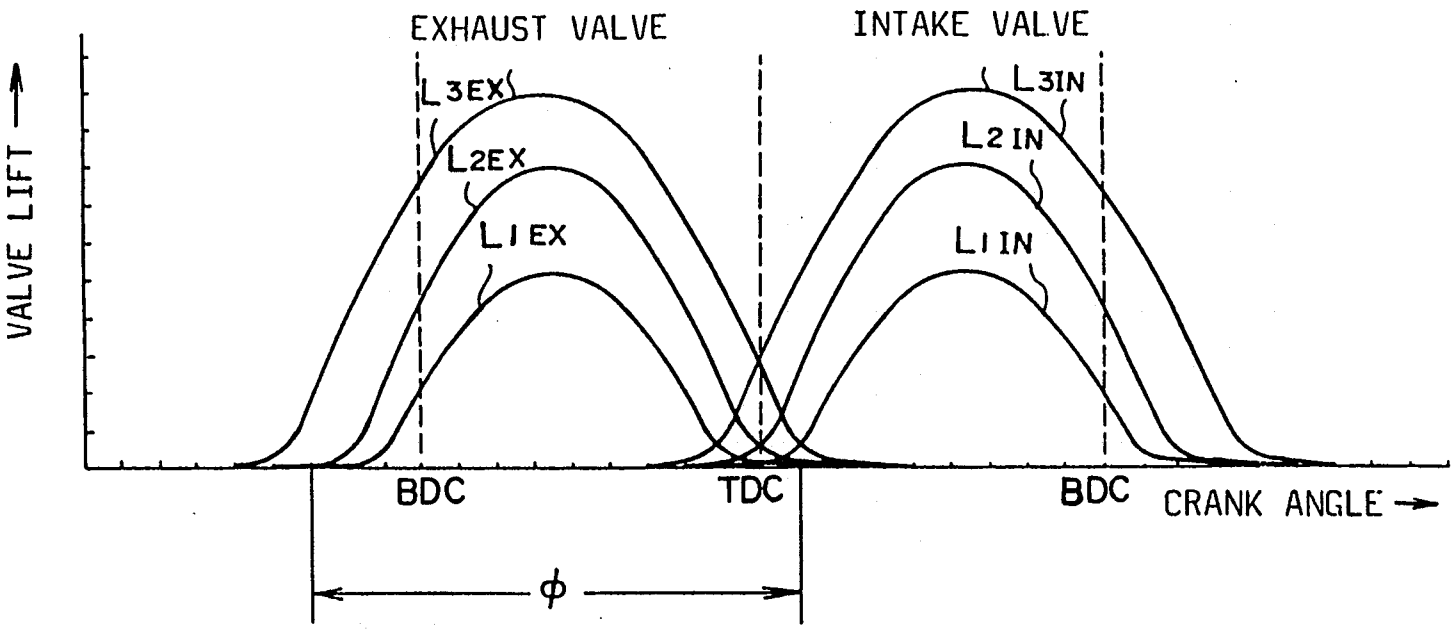
FIG. 4 is a diagram showing variation of the valve timing.

The operation of the system will be described hereinafter with reference to FIG. 4 showing the valve lift and timing.

When a base circle of the cam 10 is on the cam piston 22 of the valve lifter 20, the oil chamber 24 is supplied with oil from the oil pump 26. A part of the oil in the chamber is drained from the relief valve 30 so that the amount of oil in the chamber is kept at a predetermined volume Vo. When the cam piston 22 of the valve lifter 20 is downwardly moved by the cam 10, the oil in the chamber 24 is discharged from the relief valve 30. When the relief valve 30 closes at a controlled timing, the oil chamber 24 becomes a high pressure to provide an effective volume $V_E$. Consequently, force multiplied by the ratio of pressure receiving areas is exerted on the bottom of the lifter piston 23. Thus, the valve 3 is lifted against the spring 8 by the pressing force from the lifter piston 23 at a predetermined valve timing. When the base circle of the cam 10 comes into contact with the piston 22, the valve 3 is retracted by the spring 8 to close the port 2. In accordance with the pressure of oil in the oil chamber 24, an engagement of the cam piston 22 with the cam 10 and the engagement of the lifter piston 23 with the valve 3 are kept during the operation. In addition, thermal expansion and contraction of the valve 3 are absorbed by the valve lifter 20.

In the control unit 40, the engine speed Ne and the intake air quantity Q are supplied to the engine operating condition determining section 41 so that the engine operating condition is determined. In the valve timing determining section 42, the valve opening angle $\phi$ is derived from the table. At a low engine speed at a light engine load, the valve opening angle $\phi$ is determined to a small value. The relief valve timing providing section 43 produces a valve closing signal at a retarded time with respect to the top dead center, which is applied to the relief valve 30 through the driver 44. As a result, a large amount of the oil is drained through the relief valve 30 so that the effective volume $V_E$ of the oil chamber 24 becomes small. The valve 3 is lifted with a large delay corresponding to the delay of closing the relief valve 30, thereby reducing the valve lift. As shown in FIG. 4, characteristics of the valve lifts at the low engine speed, where the exhaust valve is opened before the bottom dead center and the intake valve is opened before the top dead center, are represented by curves $L_{1EX}$ and $L_{1IN}$, having a small opening angle $\phi$.

When the engine speed Ne and the intake air quantity Q increase the amount of oil relieved by the relief valve 30 is reduced. The effective volume $V_E$ of the oil chamber 24 becomes large, so that the valve opens at an early stage. Thus, the valve lifts are increased shown by curves $L_{2EX}$, $L_{3EX}$, and $L_{2IN}$, and $L_{3IN}$, and valve opening angles $\phi$ become large accordingly. Thus, the valve timing is controlled in accordance with the engine operating conditions to provide an optimum valve timing.

When the engine is cold, the correcting quantity providing section 47 provides the valve timing correcting quantity $\Delta T_t$. The deviation of the valve timing owing to the increase of the oil viscosity is corrected by the correcting quantity $\Delta T_t$. Thus, a proper valve timing is ensured.

At acceleration, the correcting quantity providing section 46 provides the correcting quantity $\Delta T_\theta$ corresponding to the acceleration to advance the valve closing time of the relief valve 30. Thus, the valve opening angle $\phi$ and intake air charging efficiency at the acceleration are increased, thereby increasing the engine power.

In the system, the valve 3 and the cam 10 may be inclind with respect to the valve lifter 20. The system may be used in an engine each cylinder of which has three valves or more.

In accordance with the present invention, a hydraulic valve lifter provided between the cam and the valve comprises pistons having different pressure receiving areas for the cam and the valve, respectively, so that the valve lift is multiplied by the ratio of the pressure receiving areas. Thus, the cam can be reduced in size.

Since the cam is engaged with the large diameter cam piston and the valve is engaged with the small diameter lifter piston, work is simplified.

Further, the volume of the oil chamber in the valve lifter is controlled by the electromagnetic relief valve in accordance with the engine operating conditions so that a proper valve timing is obtained, whereby effectively improving fuel consumption and engine power.

Since the valve timing of the relief valve is corrected by correcting quantities, the valve timing is properly controlled in accordance with the engine operating conditions.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. A valve timing control system for an internal combustion engine having a cylinder, a valve for inducing air or exhausting burned gases, a cam for operating the valve, and a hydraulic valve lifter disposed between said cam and said valve, the system comprising:

said hydraulic valve lifter comprises a cylindrical lifter body secured to said engine, a cam piston having a large area for receiving hydraulic pressure and slidably mounted in said lifter body, and a lifter piston having a small area for receiving hydraulic pressure and slidably mounted in said lifter body to define an oil chamber together with the cam piston, an outer surface of the cam piston being engaged with said cam and an outer surface of the lifter piston being engaged with said valve;

a hydraulic circuit having an oil supply passage for supplying oil to said oil chamber and a relief passage;

an electromagnetic relief valve provided in said relief passage for draining said oil chamber; and a control unit for operating said relief valve in accordance with engine operating conditions.

2. The system according to claim 1, wherein said lifter body has a large diameter cylindrical portion in which said cam piston is slidably mounted, and a small diameter cylindrical portion in which said lifter piston is slidably mounted.

3. The system according to claim 1, wherein said control unit produces a relief valve timing signal for closing said electromagnetic relief valve at a time in accordance with an engine speed.

4. The system according to claim 3, wherein said control unit produces said relief valve timing signal at a retarded time when the engine speed is low.

* * * * *